US009630744B2

(12) United States Patent
Sohler

(10) Patent No.: US 9,630,744 B2
(45) Date of Patent: Apr. 25, 2017

(54) POLYGONAL SLIDING PACKAGING WITH TWIST-AND-PUSH MOVEMENT FOR OPENING AND CLOSING

(71) Applicant: Wolfgang Sohler, Wangen-Neuravensburg (DE)

(72) Inventor: Wolfgang Sohler, Wangen-Neuravensburg (DE)

(73) Assignee: Rose Plastic AG (DE)

( * ) Notice: Subject to any disclaimer, the term of this patent is extended or adjusted under 35 U.S.C. 154(b) by 39 days.

(21) Appl. No.: 13/917,226

(22) Filed: Jun. 13, 2013

(65) Prior Publication Data

US 2013/0334220 A1 Dec. 19, 2013

(30) Foreign Application Priority Data

Jun. 13, 2012 (DE) ..... 10 2012 011 599

(51) Int. Cl.
*B65D 21/08* (2006.01)
*B65D 21/00* (2006.01)

(52) U.S. Cl.
CPC ..... *B65D 21/00* (2013.01); *B65D 21/086* (2013.01)

(58) Field of Classification Search
CPC ..... B65D 21/086; B65D 21/00; B65D 21/08
USPC ..... 220/8, 4.26, 4.27, 23.83, 23.86, 23.87, 220/23.89, 23.91, 4.03, DIG. 13
See application file for complete search history.

(56) References Cited

U.S. PATENT DOCUMENTS

| | | | | | |
|---|---|---|---|---|---|
| 193,686 | A | * | 7/1877 | Bowers | 220/8 |
| 1,370,207 | A | * | 3/1921 | Haase | 220/8 |
| 1,450,674 | A | * | 4/1923 | Marston | 220/8 |
| 4,509,656 | A | * | 4/1985 | Rosler | 220/8 |
| 4,596,340 | A | * | 6/1986 | Luther | 220/8 |
| 5,562,212 | A | * | 10/1996 | Rosler | 206/443 |
| 5,605,242 | A | | 2/1997 | Hwang | |
| 5,680,949 | A | * | 10/1997 | Roesler | 220/8 |
| 5,829,591 | A | * | 11/1998 | Lyons | 206/373 |
| 8,789,694 | B2 | * | 7/2014 | Roesler | 206/349 |
| 2009/0308867 | A1 | | 12/2009 | Lal | |

FOREIGN PATENT DOCUMENTS

| | | |
|---|---|---|
| DE | 76 20 793 | 10/1976 |
| DE | 79 36 611 | 12/1979 |
| DE | 4406932 C2 | 9/1995 |
| GB | 1 488 074 | 10/1977 |
| WO | 94/24008 | 10/1994 |

* cited by examiner

*Primary Examiner* — Stephen Castellano
(74) *Attorney, Agent, or Firm* — Cohen & Grigsby, PC

(57) ABSTRACT

Polygonal sliding packaging having an inner hollow body (3) which slides telescopically within an outer hollow body (2) to form a variable length container which uses a twist-and-push or pull movement for closing and opening. The two hollow bodies are latched using assigned latchways (13-2 to 13-3), which are at least a first row of notches (6, 7) with at least one latch notch (5) disposed on one hollow body (3) and at least a second row of notches (9 through 12) with at least one latch notch (8) disposed on the other hollow body (2). Latchways are disengaged by twisting the two hollow bodies counter to one another about their longitudinal axes so that the latch notches of one latchway (13-3) reside within at least one slideway (14-2, 15-2), which is disposed on one hollow body (2) in a circumferential direction at a distance from the at least one latchway (13-2).

15 Claims, 8 Drawing Sheets

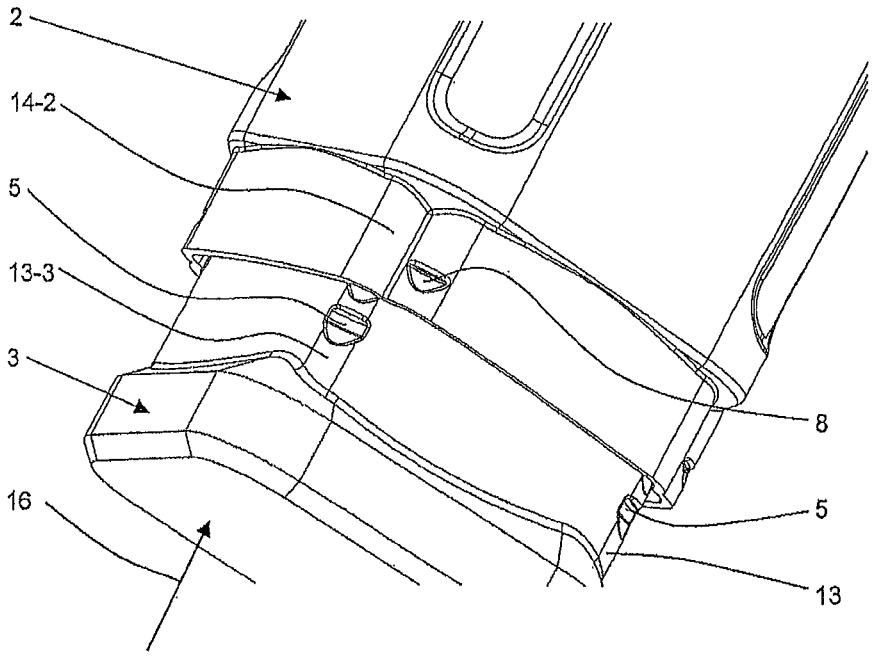
Fig. 2 (Sliding position)
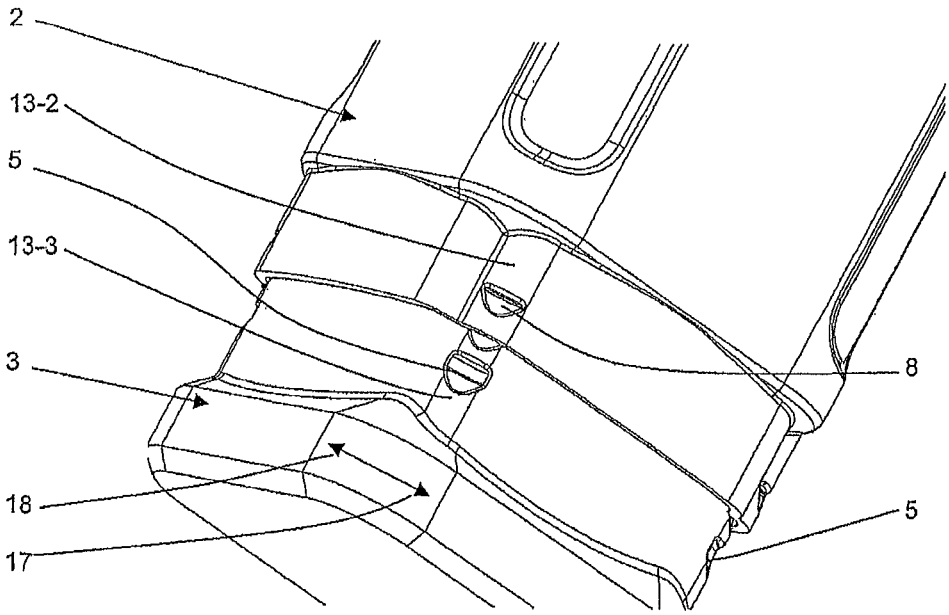
Fig. 3 (Locked position)

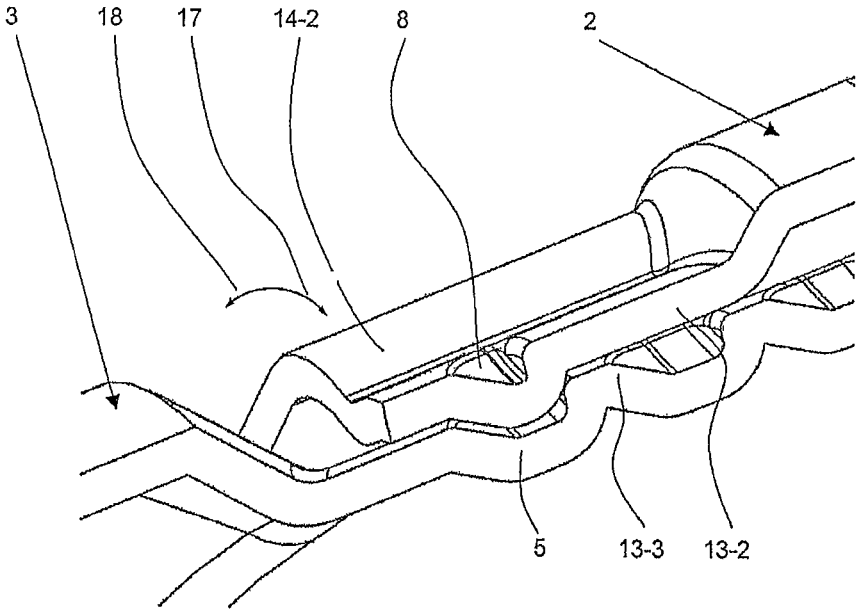
Fig. 4 (Locked Position)
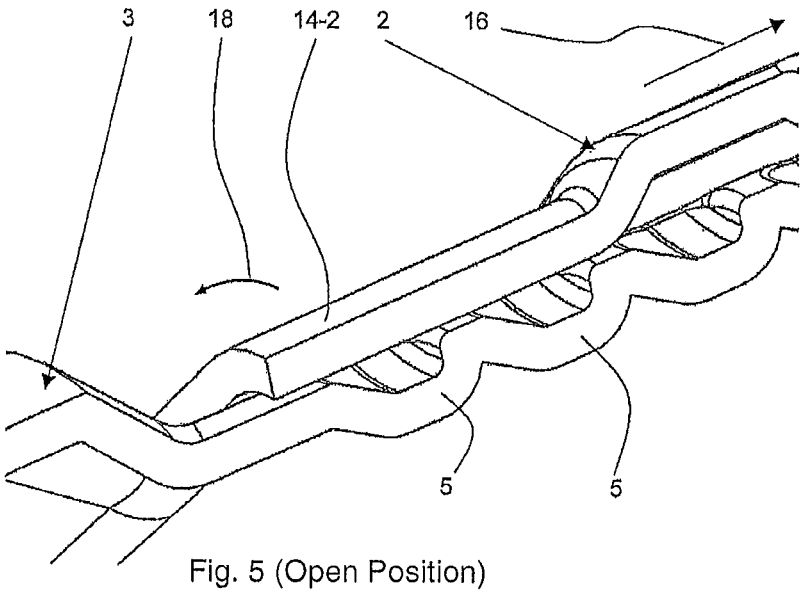
Fig. 5 (Open Position)

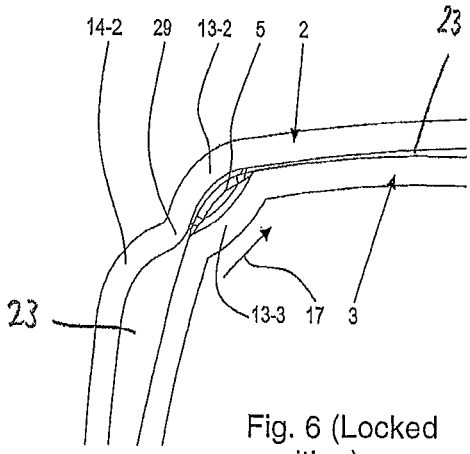
Fig. 6 (Locked position)
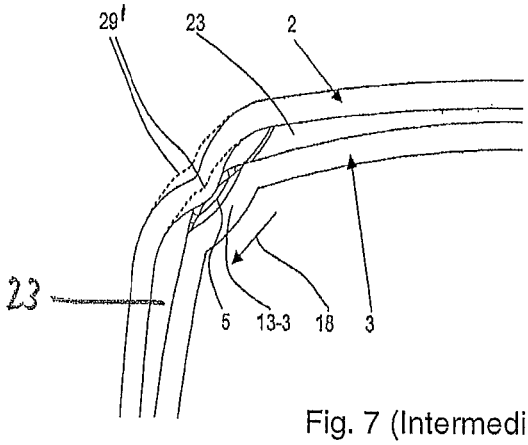
Fig. 7 (Intermediate position)
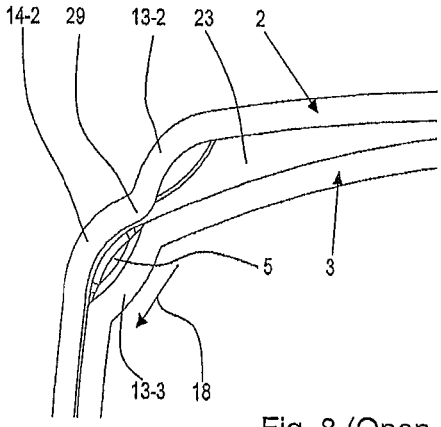
Fig. 8 (Open position)

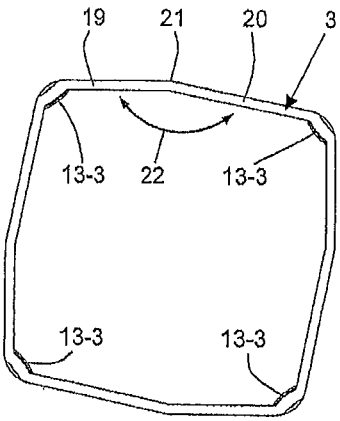
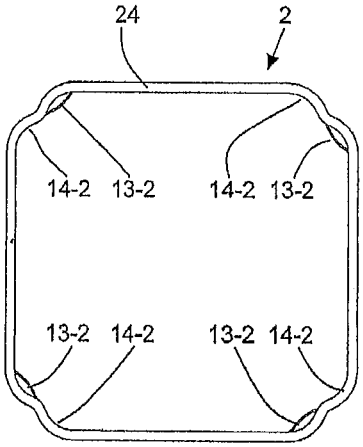
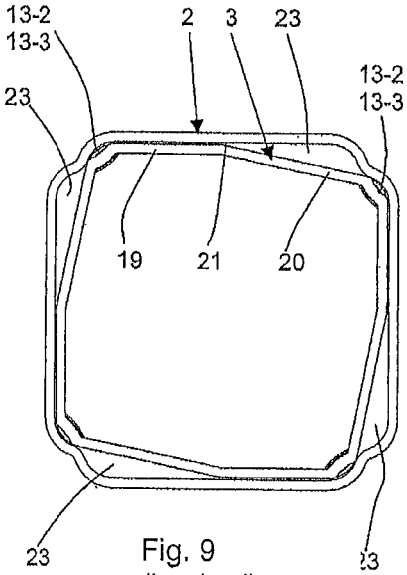
Fig. 9
(Locked)
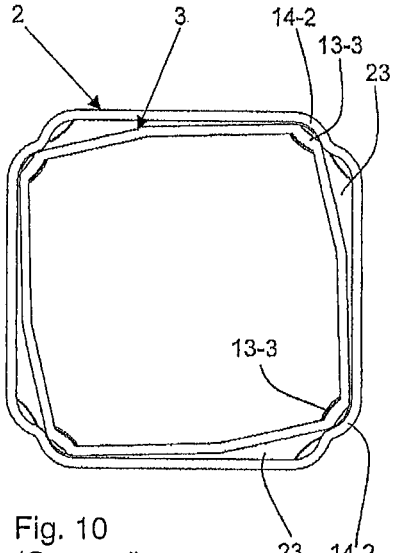
Fig. 10
(Opened)

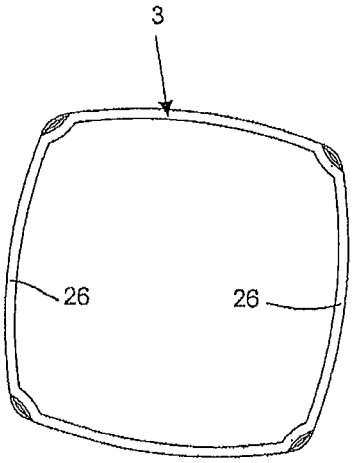
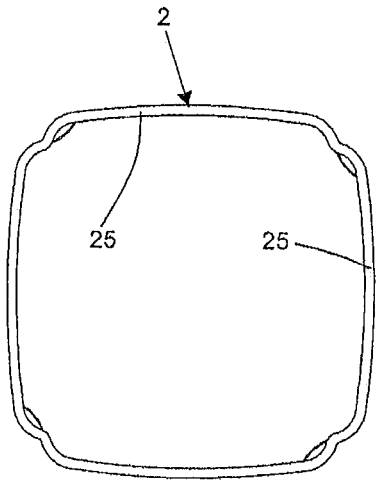
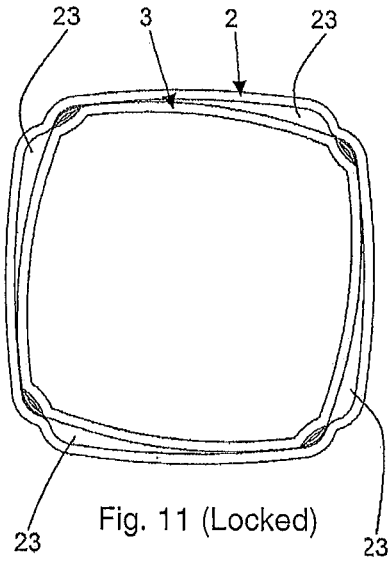
Fig. 11 (Locked)
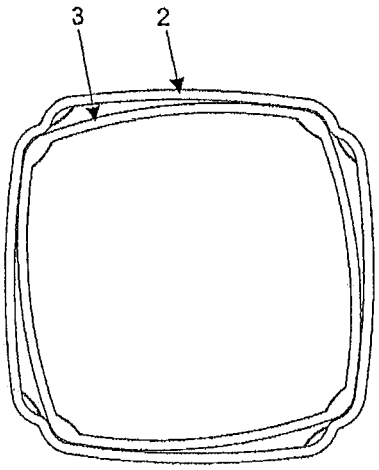
Fig. 12 (Opened)

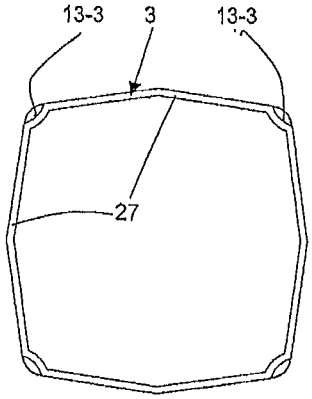
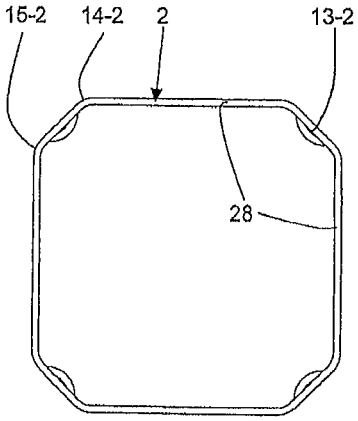
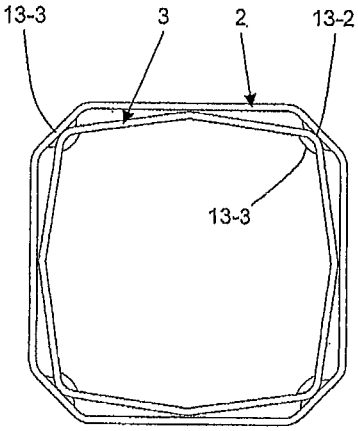
Fig. 13 (Locked)
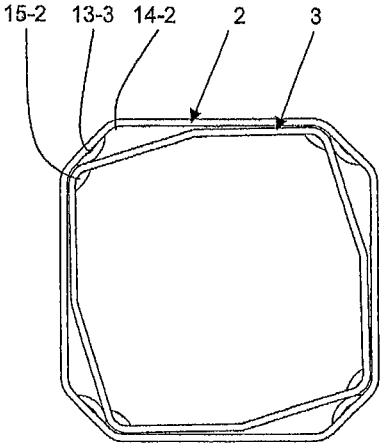
Fig. 14 (Opened)

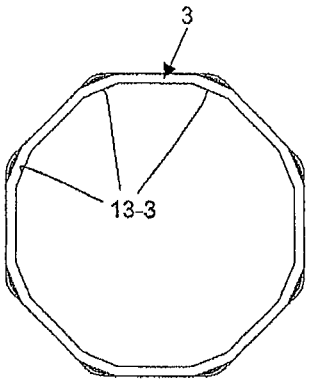
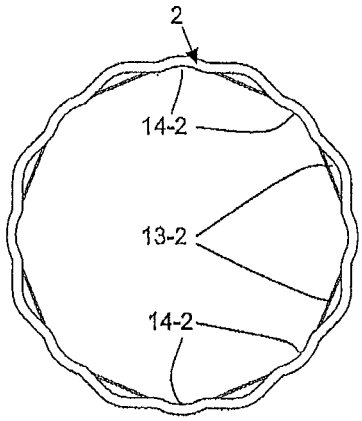
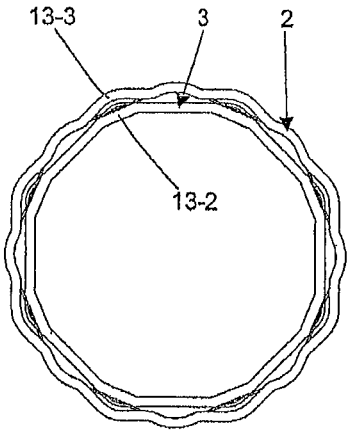
Fig. 15 (Locked)
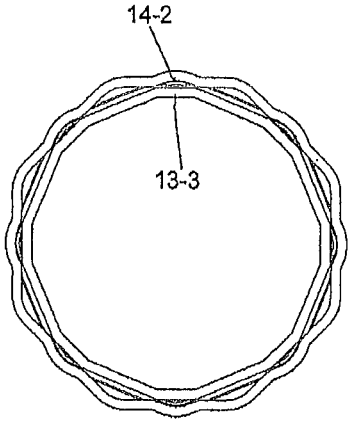
Fig. 16 (Opened)

POLYGONAL SLIDING PACKAGING WITH TWIST-AND-PUSH MOVEMENT FOR OPENING AND CLOSING

CROSS REFERENCE TO RELATED APPLICATIONS

The present application claims the benefit of priority of Application No. 10 2012 011 599.7 filed in Germany on Jun. 13, 2012, the rights of priority of which are claimed in the present application and the subject matter of which is incorporated herein by reference in its entirety.

BACKGROUND OF THE INVENTION

1. Technical Field of the Invention

The presently disclosed invention relates to a polygonal packaging having an inner hollow body, an outer hollow body, and a latch arrangement, wherein the inner body slides telescopically within the outer body to create a container of variable length. A twist-and-push or pull movement is used for engaging or disengaging the latch arrangement and thus closing or opening the two hollow bodies assigned to each other.

2. Background of the Invention

Sliding packaging may comprise two hollow bodies each of which is closed on one face and open on the opposite face. These hollow bodies can be connected to one another by sliding one into the other telescopically and use a latch arrangement which comprises at least a first row of notches disposed on one hollow body with at least one latch notch and at least a second row of notches disposed on the other hollow body with at least one latch notch. The hollow bodies may be latched when the first row of latch notches interlocks with the assigned second row of latch notches when the hollow bodies slide one into the other. In order to separate the two hollow bodies the touching rows of notches can be disengaged by twisting the two hollow bodies counter to one another about their longitudinal axes.

Such prior art has become partially known through German patent publication DE4406932 C2. In this packaging container a variable length is obtained using latchways that are arranged on the corners of an outer sleeve, which have rows of latch notches which engage with rows of notches that are provided in sequence on the corners of an inner sleeve, in the direction of sliding, which form a latchway.

In German patent publication DE4406932 C2, the corner of the latchway of the inner sleeve is attached to the corner of the latchway of the outer sleeve, and the two parts can be connected to one another by simply sliding the inner sleeve into the outer sleeve. The latching arrangement is intended so that the latchway of the inner sleeve is slid open on the latchway of the outer sleeve.

After the two latchways have been locked together by direct interlocking, the latching movement effected by push or pull is relatively difficult and is only achieved with greater pushing force or contrary opening force. For this reason the mentioned German patent publication DE4406932 C2 proposes that the outer and inner sleeves can be twisted relative to one another in order to achieve the open and closed position.

In the open and closed position it is intended that the latchway of the inner sleeve, for example, is disengaged from the latchway of the outer sleeve arranged on the corner side. In this open and closed position the two parts are able to slide against each other a little and can be set to any arbitrary length to each other and through renewed mutual twisting of the hollow bodies their latchways are engaged again.

Such a packaging container has been widely proven. The disadvantage of the known packaging container, however, is that the transition from the locked position to the open position can only occur through deformation of the wall of the outer sleeve, which must deform with its walls flexing radially outward, to allow a clearance for the latchway of the inner sleeve to slide along the inside of the outer sleeve. A high torque is therefore required to twist the two parts against each other, whereby the container walls of the outer sleeve must move flexibly outward. Such increased torque is not desirable.

Another disadvantage of the known packaging sleeve is that the whole latch only then works if at least the material of the outer sleeve is designed to be flexibly pliant. With a relatively rigid plastic material or even other materials, such as wood, cardboard, paper, metal and similar materials, for example, which have no high deformability, the known latch according to German patent publication DE4406932 C2 does not work because the flexibility of the outer sleeve does not exist in the required dimension.

It is therefore an object of the presently disclosed invention to develop a packaging container which may allow the sliding position to be effected by twist-and-push or pull movement between an outer sleeve and an inner sleeve using as little sliding force as possible. That is, the transition between the locked position and the open position of the packaging container may be achieved using less force and even when less flexible materials are used for the outer sleeve.

SUMMARY OF THE INVENTION

The object is achieved by the presently disclosed invention which relates to a polygonal packaging having an inner hollow body, an outer hollow body, and a latch arrangement, wherein the inner body slides telescopically within the outer body to create a container of variable length. A twist-and-push or pull movement is used for engaging or disengaging the latch arrangement and thus closing or opening the two hollow bodies assigned to each other.

A novel feature of the presently disclosed invention is that on the interlocking surfaces of the outer sleeve and inner sleeve in the direction of the displacement at least one latchway is disposed on the one part, which is aligned in a longitudinal direction to the direction of the displacement, and that at least one latch notch exists on the other part, which can interlock with this latchway. In addition, at least one slideway is arranged in the circumferential direction at a distance to the latchway, in which the latchway of the opposite part can be interlocked and can be slid there freely in the direction of the displacement.

It is therefore important to the presently disclosed invention that at least one slideway is arranged at a radial distance (i.e. around the circumference) to the latchway running in a longitudinal direction to the one part and opposite to the other part, and the latchway on the one part can be twisted through twisting between the two parts so that the latchway on the one part interlocks with the slideway on the opposite part.

The existence of at least one slideway is a substantial difference to the prior art, since in the prior art according to German patent publication DE4406932 C2 such a slideway was not provided. Here it was only intended that the latchway arranged on the corner-side of the outer sleeve pointed inward and the inner sleeve on the corner-side had outward-facing latch notches. When the two parts were twisted, the latch notches arranged on the outer side of the inner sleeve leant against the wall of the outer sleeve and deformed the sleeve flexibly outward. Through this twist and subsequent pull or push movement the latch notches on the one part disengaged from the latchway on the opposite part of the packaging sleeve.

This deformation is no longer necessary after the presently disclosed invention, since slideways according to the present application exist in the one hollow body, so that a flexible deformation is no longer necessary during the twisting of the two hollow bodies. This results in the advantage that the outer sleeve no longer needs to be made of a flexibly pliant material, since it no longer depends on the pliability of the walls of the outer sleeve. Instead, one or several slideways are arranged at a radial distance next to the latch notches of the outer sleeve, whereby the presently disclosed invention claims a plurality of possibilities as essential.

In one preferred embodiment the slideway is trapezoidal or U-shaped, for example, designed with the groove of its closed groove base oriented radially outward in the wall of one hollow body.

The term 'slideway' is not limited to the latch notch or latch notches on the one part of the packaging sleeve in touching and sliding contact with the slideway on the opposite part. The latch notch or latch notches on the one part of the packaging sleeve must not necessarily touch the slideway. They can also be introduced without making contact over the slideway, which then serves as a longitudinal guide element for a straight guide of the latch notches arranged on the opposite part of the packaging sleeve.

The term 'latchway' is used in this general form due to it being the simpler description, although the 'latchway' may also only consist of one single notch.

In a first embodiment it is intended that only a single notch is provided on the outer sleeve or optionally several notches arranged in sequence, which form a row of notches. It is important that at least one slideway is arranged on this outer sleeve at a radial distance and offset on the circumference next to this/these one or several notches.

In one other embodiment of the presently disclosed invention it is intended that the notches exist on all or some corners or on any other surfaces of this outer sleeve, so that in the invention it does not matter that the slideway and/or latchway is/are arranged on the corner side. These may also be arranged on any other surface in a longitudinal direction (push and pull direction), aligned both on the outer sleeve and on the inner sleeve.

In addition, it is not essential to the solution that only one single slideway exists in total. Such a slideway can be arranged at each corner in the case of a quadrangular body. But they may also be arranged—with regard to a body corner extending in the longitudinal direction—left and right of the latch notch (or in general: the latchway), so that two slideways are arranged on each corner at a distance from each other and offset to each other on the circumference.

The presently disclosed invention is, incidentally, not limited to a quadrangular body as packaging sleeve. Any polygonal body may be used, such as a triangular, quadrangular, pentagonal, hexagonal, octagonal, dodecagonal or symmetrical polygonal body, for example, or a similarly shaped, asymmetrical packaging body. Round bodies may also be used, on condition that such round bodies feature the properties described above.

The presently disclosed invention is based on the knowledge that one or several slideways are arranged on the part of the sleeve opposite the latchway, which allow an almost force-free sliding of the latch notches of the latchway into the opposite hollow body using a twist-and-push or pull movement. Thus a slight displacement force between the hollow bodies is given in the open or closed position, without the two hollow bodies having to be deformed when they are twisted.

The two hollow bodies may also be slightly joined to any latch position on the length of the packaging, in which the one hollow body is twisted relative to the other hollow body and is then locked.

The presently disclosed invention is not limited to only one or two corner-side latchways being arranged on the inner sleeve. Instead of a single latchway, diagonally opposite corner-side latchways may also be provided. Such latchways may be provided on each body edge in the case of a quadrangular body.

However, it is not essential to the solution of the general object that the latchways are arranged in the corner area. They may also be arranged on any other surface of the sleeve body and must therefore be provided on the corner-side not essential to the solution.

It is preferred if a specific elastic resistance is to be overcome in the circumferential direction in the transition from the latchway to the slideway. This resistance is advantageously noticeable during the twisting of the two parts. To this end, the presently disclosed invention provides that in the transition area between the slideway and the latchway on the one sleeve part a deforming edge projecting radially inward is provided, which when swiveling the latchway attached to the other part from the latch position to the slide position skims this deforming edge and deforms it slightly to allow such a noticeable resistance when the two parts are twisted from the open position to the closed position and vice versa.

It is preferred, but not essential to the solution, to provide such a deforming edge. If the deforming edge is removed, the two bodies can be engaged in the latch position and vice versa without significant torque from the release position (open position).

Other deforming means may also be used in a deforming edge continuing in a longitudinal direction, such as a lip molded on one sleeve part or molded knobs, for example, which flexibly deform when the two sleeve parts aligned opposite each other are twisted and oppose a specific torsion pressure of the twisting.

Since the latch notch arranged on the one part swivels in a circular manner to the latch notches attached in the area of the latchway on the other part, it is also possible, during the radial movement of the two parts to one another, to provide in this area of movement knob tabs or similarly deformable elastomer bodies which are deformed during the swiveling or during the relative movement of the two parts to one another.

With the features according to the presently disclosed invention there results for the first time the advantage that it no longer depends on the flexibility of the outer sleeve. Accordingly the inner and outer sleeves may be manufactured out of a very rigid and bend-resistant material. This comes with the advantage that with the packaging according to the presently disclosed invention very heavy objects may also now be packed, which due to their weight are no longer in the position to open the hollow bodies locked together, even if these are in the locked position. Such a packaging can therefore also withstand high shock and impact, without there being any danger of the interlocked hollow bodies becoming accidentally disengaged.

Nevertheless, a slight rotational ability of the two hollow bodies against one another is ensured and the two packaging bodies can be twisted slightly against each other and displaced to open the packaging or to choose the packaging length.

The object of the presently disclosed invention arises not only from the subject-matter of the individual claims, but also from the combination of the individual claims among each other.

BRIEF DESCRIPTION OF THE DRAWINGS

Everything in the documents, including the details and features disclosed in the abstract, in particular the spatial design illustrated in the drawings, are claimed as essential to the presently disclosed invention, insofar as they are individually or in combination new compared to the prior art.

The presently disclosed invention is explained in more detail below by means of the drawings illustrating an embodiment. Additional features and advantages of the invention that are essential to the invention hereby emerge from the drawing and its description.

In the drawings:

FIG. 1 shows a perspective view of a first embodiment of the packaging container according to the presently disclosed invention with the inner hollow body separated from the outer hollow body;

FIG. 2 shows an enlarged perspective view of an interlocking of the two sleeve parts in the sliding position;

FIG. 3 shows the same illustration as FIG. 2 in the locked position;

FIG. 4 shows a view of a longitudinal cross section through the two interlocked parts in the locked position;

FIG. 5 shows the same section illustration as FIG. 4 in the open position;

FIG. 6 shows a partial view of a cross section of the two interlocked parts in the locked position;

FIG. 7 shows a partial view of a cross section of the two parts in the interim position during the transition from the locked position according to FIG. 6 to the open position according to FIG. 8;

FIG. 8 shows a partial view of a cross section of the two interlocked parts in the open position;

FIG. 9 shows a view of a cross section of the two interlocked parts in the locked position with a single illustration of the inner sleeve;

FIG. 10 shows a view of a cross section of the two interlocked parts in the open position with a single illustration of the outer sleeve;

FIG. 11 shows a view of a cross section of an embodiment of the outer sleeve and inner sleeve in the locked position modified compared to FIG. 9 with a single illustration of the inner sleeve;

Figure 1:
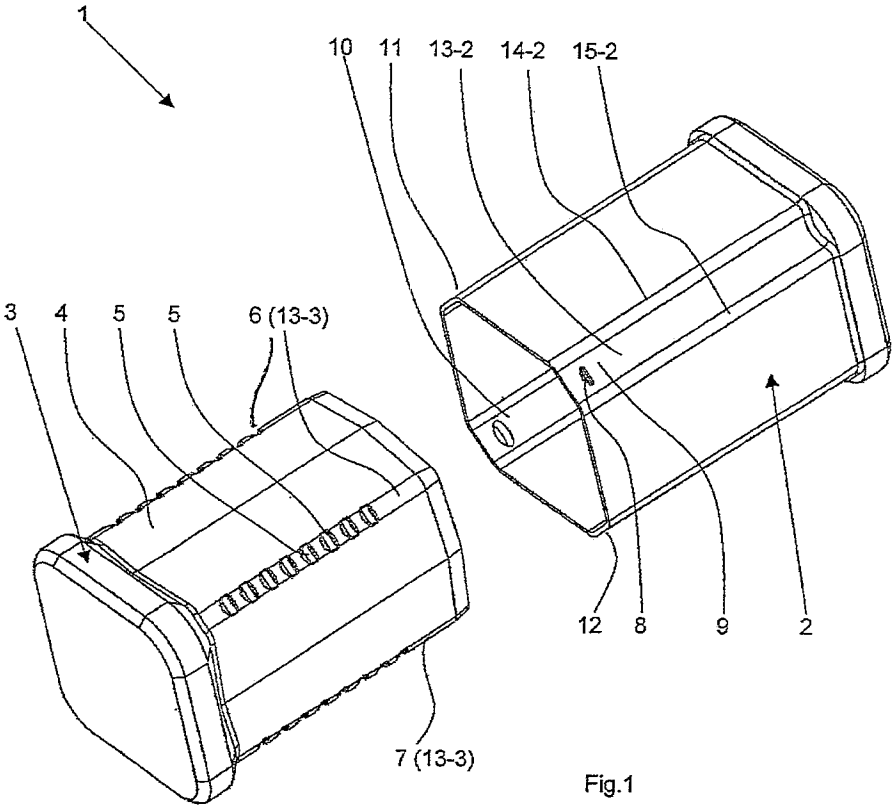

FIG. 12 shows the same illustration as FIG. 11 in the open position;

FIG. 13 shows a view of a cross section of an embodiment of the outer sleeve and inner sleeve in the locked position modified compared to FIG. 11 with a single illustration of the inner sleeve;

FIG. 14 shows the same illustration as FIG. 13 in the open position;

FIG. 15 shows a view of a cross section of an embodiment of the outer sleeve and inner sleeve in the locked position modified compared to FIG. 9 with a single illustration of the inner sleeve; and FIG. 16 shows the same illustration as FIG. 15 in the open position.

DESCRIPTION OF PRESENTLY PREFERRED EMBODIMENTS

A packaging container 1 comprising one outer sleeve 2 and one inner sleeve 3 is illustrated in FIG. 1.

The terms 'outer sleeve' and 'inner sleeve' are only to be understood as examples. They only refer to the current function of the two parts, which is illustrated in the drawing. The terms can be exchanged in the description and also in the claims and are not limiting for the presently disclosed invention.

FIG. 1 also shows an inner sleeve 3, which features an approach 4 of reduced diameter at the front, which, however, is not essential to the solution. The rear part of the inner sleeve 3 could also be completely removed and the approach 4 could extend over the whole length of the inner sleeve to the back at the bottom and be closed there in the bottom area.

Also not illustrated is that two or three handle connectors may be arranged on the bottom closed side of the outer sleeve and inner sleeve, which can be gripped with the hand as a handhold, in order to slide the two parts together or to twist them against one another.

Since it was mentioned at the outset, that the outer sleeve 2 no longer depends on the flexible deformation and that this can also be made out of a heavily deformable material, such as a thick-walled plastic, a sheet of metal or the like, for example, this also applies to the material of the inner sleeve.

When the inner sleeve does not in any case depend on a wall deformation of the wall part of the inner sleeve, but only on a flexible deformation of the latch notches 5 arranged there, which are arranged in the area of one or several rows of notches 6 arranged on the corner side.

As already mentioned in the general description, the embodiment according to the drawings is only to be understood as an example, since the embodiment according to FIG. 1 shows that the latch notches 5 with the rows of notches 6, 7 are each arranged diametrically opposed to each other in corners of the inner sleeve 3. This is, however, to be understood as not limiting for the invention. The rows of notches 6, 7 can be arranged anywhere else on its surface outside the corner of the inner sleeve 3.

To better distinguish the assignment of the individual parts with regard to their affiliation to the outer sleeve 2 and the inner sleeve 3, combined reference characters are used in the following description, where each reference character features one hyphen and one underlying number 2 or 3. The hyphen and the number 2 mean that this part belongs to the outer sleeve, while the hyphen and the number 3 mean that this part belongs to the inner sleeve 3.

An outer sleeve 2 is provided opposite the inner sleeve 3 as a square sleeve body. In the embodiment latch notches 8 are arranged on all four corners of the outer sleeve.

It is, however, sufficient for the functionality of the presently disclosed invention to provide only one single latch notch 8. However, several consecutive latch notches 8 may also be provided. The latch notches 8 form in this case each corner-side row of notches 9, 10, 11, 12.

Here also the presently disclosed invention is not limited to the arrangement of the rows of notches 9 through 12 on the four corners of the four-sided outer sleeve 2. The rows of notches 9 through 12 may also be provided only in twos and in this case diametrically opposite each other. It is also sufficient to arrange one single row of notches either on the side of the edge or anywhere on the surface of the outer sleeve 2 in the push direction.

On the one hollow body, in the embodiment shown on the inner sleeve 3, latch notches 5 are arranged, which with the respective row of notches 6 form a latchway 13-3. The latchway 13-3 comprises individual latch notches 5 in sequence and at regular intervals from each other.

Opposite and aligned to this latchway 13-3, namely the outer sleeve 2, a latch notch 8 described above or a plurality of latch notches in the form of the row of notches 9-12 are arranged on the opposite part.

It is important that at least one single slideway 14-2 is arranged at a radial distance, i.e. offset around the circumference, at a distance next to one or several of the rows of notches 9 through 12. This is illustrated in FIG. 2.

The slideway represents a clearance, if the two sleeve parts 2, 3 are inserted together in such a way that the latchway 13-3 of the inner sleeve 3 engages with the slideway 14-2 in the area of the outer sleeve 2, and the two parts can therefore be displaced into each other using virtually no force.

It is designed as a half-open groove extending in a longitudinal direction of the outer sleeve 2, whose closed groove base is aligned radially outward. It is then open to the inner side of the outer sleeve 2. The length of the slideway 14-2 corresponds to the desired displacement length between the inner and outer sleeves 2, 3. A preferred design is a U-shaped or trapezoidal groove. The groove contour corresponds to the contour of the notches 5 (or a row of notches formed from several notches 5) displaceable in this slideway 14-2 and is chosen so that the notch 5 can be displaced easily in this contour-shaped slideway 14-2, but is guided back along the side of the groove during the displacement movement.

For latching according to FIG. 3 the two hollow bodies 2, 3 are again twisted towards each other at the angle of their longitudinal axis in the direction of rotation, so that in any adjustment of the length the latch notches 5 in the area of the latchway 13-3 match the latch notches 8 arranged on the opposite part, which are arranged in the area of a latchway 13-2. The result is a heavy-duty latching intervention that can also withstand high push-out forces between the hollow bodies 2, 3 through the barb form of latch notch 5 and the opposite latch notches 8.

FIG. 1 still shows a modified embodiment, since an additional slideway 15-2 can be arranged on the other side with regard to the latchway 13-2, opposite the slideway 14-2, so that both during the twisting, e.g. in the clockwise direction from the outer sleeve to the inner sleeve 2, 3 the latchway 13-3, e.g. is engaged with the slideway 14-2, while during twisting in the opposite direction the latchway 13-3 of the inner sleeve 3 reaches the displacement area of the slideway 15-2.

In this second embodiment, therefore, there are two slideways in the longitudinal direction, which are arranged on both sides of the latchway 13-2 arranged on the inner sleeve.

FIGS. 2 and 3 show an enlarged illustration of the details according to FIG. 1. In FIG. 2 it is obvious that, for example, the inner sleeve 3 is displaced in the direction of the arrow 16 against the fixed outer sleeve 2, and in the illustrated displacement position it is obvious that the latch notches 5 forming the latchway 13-3, reach the area of the slideway 14-2 on the outer sleeve 2 and the two parts are therefore readily displaceable against each other in the direction of the arrow 16 and in the opposite direction.

In order to get from the displacement position according to FIG. 2 to the latch position according to FIG. 3, it is intended, for example, that the inner sleeve 3 is twisted in the direction of the arrow 17 with regard to the fixed outer sleeve 2, so that the respective latch notch 5 on the adjusted length adjustment between the two sleeves 2, 3 engages with any latch notch 8 on the outer sleeve 2. In this way, any arbitrary length change between the two sleeve parts 2, 3 can be locked.

Based on FIG. 3, to achieve the open position again, the inner sleeve 3 is twisted in the direction of the arrow 18—opposite to the direction of the arrow 17—with regard to the fixed outer sleeve 2.

The presently disclosed invention also allows that the two parts in the locked position, without mutual twisting, can be locked to each other by overcoming a higher displacement pressure. This was already the subject of German patent DE 33 25 033 C2. This opportunity is also provided in the presently disclosed invention.

FIGS. 4 and 5 show in a sectional illustration the two hollow bodies in the locked position (FIG. 4) and in the open position (FIG. 5). It is obvious that the latch notch 5 in the area of the inner sleeve 3 can be engaged with the assigned latch notch 8 in the latchway 13-2 of the outer sleeve 2.

If, however, based on the locked position in FIG. 4, it is twisted in the direction of the arrow 18, then the two notches become disengaged and the latch notches 5 on the inner sleeve 3 engage with the slideway 14-2 in the area of the outer sleeve 2 designed as a single-sided open symmetrical hollow contour groove, so that the two parts are therefore freely displaceable against each other in the direction of the arrow 16 and in the opposite direction and are able to be locked to each other in any arbitrary displacement position.

Thus, an embodiment of the presently disclosed invention is a polygonal sliding packaging having a variable length with a twist-and-push movement for opening and closing, comprising two hollow bodies (2, 3) connected to one another by sliding them into one another, having a latch arrangement which comprises at least one first row of notches (6, 7) provided on one hollow body (2, 3) with at least one latch notch (5) and with at least a second row of notches (9 through 12) disposed on another hollow body (2, 3) assigned to the first row of notches (6, 7) with at least one latch notch (8), which interlock and latch together with their assigned touching notch edges to the latch notches (5, 8) when the hollow bodies (2, 3) slide into one another, where in order to separate the two hollow bodies (2, 3) the touching rows of notches (6, 7; 9 through 12) can be disengaged by twisting the two hollow bodies (2, 3) counter to one another about their longitudinal axes, where at least one slideway (14-2, 15-2) is disposed on the one hollow body (2, 3) in the circumferential direction at a distance from at least one latchway (13-2, 13-3), in which the at least one latchway or the at least one latch notch of the opposite hollow body (3, 2) can be interlocked and can be slid there in the direction of the displacement.

FIG. 6 shows the latching of the two sleeve parts 2, 3. The latchway 13-3 in the area of the inner sleeve 3 is interlocked with the latchway 13-2 in the area of the outer sleeve 2. The slideway 14-2 also lies in the circumferential direction. A deforming edge 29 is arranged in the outer sleeve 2 between the latchway 13-2 and the slideway 14-2. The deforming edge 29 is aligned radially inward and could, for example, extend over the entire length of the outer sleeve 2 and is then, for example, just as long as the slideway 14-2. The deforming edge 29 can also, however, only be provided piece by piece in the form of one or several knobs. Segments may also be present, or a flexible lip, which extends partially or wholly aligned over the length of the outer sleeve 2 and is aligned radially inward.

If it is swiveled in the transition of FIG. 6 to the open position according to FIG. 8, this takes place in the direction of the arrow 18 according to FIG. 7. An intermediate position is illustrated there. It is obvious that the latchway 13-3 on the inner sleeve 3 flexibly deforms the deforming edge 29 slightly outward in the position 29' and because of this a torque results during the mutual twisting of the two parts in the direction of the arrow 18, in order to allow a specific noticeable torque between the locked position and the displacement position. The presently disclosed invention may, however, also waive such a deforming edge 29 and the generation of a force component against the rotation.

It is important that there is a clearance 23 between the parts that are able to be twisted against each other. That is, the clearance 23 is provided between the outside of the inner sleeve and the inner side of the outer sleeve 2. The clearance 23 is defined by the different profile form of the inner and outer sleeve 2, 3, as explained by means of the subsequent FIGS. 9 through 16.

After overcoming the intermediate position and any flexible deformation of the deforming edge 29, which is arranged on the outer sleeve 2, the latchway 13-3 reaches the inner sleeve 3 in the profile area of the slideway 14-2 of the outer sleeve 2, so that the two parts are freely displaceable against one another. They may be locked in any arbitrary displacement position again by twisting in the direction of the arrow 17 (FIG. 6).

The clearance 23 necessary for the force-free twisting between the two sleeve parts 2, 3 must not therefore be formed so that the profile form of the inner sleeve 3 is displaced inward against the outer sleeve 2. It may also be provided in another embodiment—not illustrated in drawings—that the inner sleeve 3 features a straight contour and the outer sleeve 2 is aligned bulbously outward, so that in this case also a free twisting of the two sleeve parts 2, 3 is possible.

However, FIGS. 9 through 16 show that the profile form of the inner sleeve 3 differs from the profile form of the outer sleeve 2, as explained in the following discussion and in the figures.

FIGS. 9 and 10 show a ridge-shaped profiling of the inner sleeve 3 in comparison to a straight-profiled outer sleeve 2. The ridge shape is achieved by two straights 19, 20 arranged at an angle to each other on the profile of the inner sleeve 3, where the straights intersect at an angle 22 in the area of an apex 21 roughly in the middle of a wall.

In contrast, the wall shape of the profile form of the outer sleeve 2 illustrated above in FIG. 10 features straight walls, and it is obvious from FIGS. 9 and 10 (locked position and open position) that there is always a clearance between the inner wall of the inner sleeve and outer wall of the sleeve when the two parts are twisted, to allow a force-free twisting of the two parts without flexible deformation of the wall of the outer sleeve 2. The outer sleeve 2 then has straight walls 24.

In contrast, FIGS. 11 and 12 illustrate that the inner sleeve 3 features bulbous side walls, since the curve 26 of the inner sleeve 3 is assigned and an additional but differently rounded curve 25 is assigned to the outer sleeve 2.

There are therefore two different rounded curves 25, 26 inserted into each other and twisted towards each other, so that with the mutual twisting of the two parts the clearance 23 between the two profiles forms results.

This is also shown by FIGS. 13 and 14, which each show the locked position and open position. Here it is obvious that the inner sleeve 3 again features a ridge-shape, as was also illustrated in FIG. 9. Here the beveled form 27 is designed fully symmetric, while it was designed asymmetric in FIG. 9.

The fully symmetrical beveled form 27 in the profile allows the inner sleeve 3 with regard to the outer sleeve 2 both in the direction of the arrow 17 to the left and in the direction of the arrow to the right to bring each into a locked position and a open position, since in the second embodiment according to FIG. 1 in addition to the slideway 14-2 another slideway 15-2 is arranged symmetrically to the latchway 13-2.

In FIG. 14 it is obvious that the outer sleeve 2 has a straight form 28, which corresponds roughly with the straight form 24 according to FIG. 10.

FIGS. 15 and 16 show that multiple polygonal bodies may also be interlocked in the way described. The inner sleeve 3 has a plurality of uniformly distributed latchways 13-3 arranged on the circumference and opposite the outer sleeve 2 has a plurality of slideways 14-2 and latchways 13-2 distributed on the circumference and differing from each other.

In this way a multiple locking of the two inner and outer sleeves 2, 3 of this multiple polygonal body is provided according to FIGS. 15 and 16.

The presently disclosed invention is, incidentally, not limited to the two hollow bodies each being closed on one end face and being open on the opposite end face. This is only one of the possible embodiments.

In another embodiment it is intended that a single hollow body exists whose two opposite end faces have been removed so that it is designed as a continuous sleeve on whose two ends the latchway and slideway according to the presently disclosed invention are designed. Such a hollow body is called a connection adapter because in each of the two open end faces an opposite hollow body can be guided in and fixed by means of the twist-and-push movement according to the presently disclosed invention to engage with the latchway and slideway arranged there. The opposite hollow body introduced is then closed on its one end face and open on the other end face, namely on the end face with which it is introduced into the connection adapter.

From the other side of the connection adapter a hollow body that is identical or differently shaped or equipped with different length and also with its opposite end face closed may be introduced and fixed. In this way, hollow bodies that are equally long or which have different length may be introduced and fixed in both opposite open end faces of the connection adapter, so that overall a three-part sliding packaging results, which may be very long, since its length is defined by the lengths of the hollow body to be introduced from each side into the connection adapter.

The connection adapter may also be designed so that on its one open end face a specific multiple-edged profile is formed and is provided for locking with a hollow body with a similar profile, while on the opposite open end face of the connection adapter another profile is formed, which is able to be locked with an assigned hollow body having this other profile. In this way, not only can hollow bodies of different lengths be locked together to the connection adapter, but hollow bodies with different profiles.

If in the case of the hollow bodies to be locked to the connection adapter the respective outer end face is also removed, one-sided or two-sided open tubes of any length and profile form can be created with the connection adapter and with the hollow bodies, each open on the end face, to be locked to it.

I claim:

1. Packaging that has an adjustable length, said packaging comprising:

a first body having an outer surface and an inner surface that is oppositely disposed from said outer surface to define a wall between said outer surface and said inner surface, said wall defining a first polygonal profile and being located circumferentially around a longitudinal axis of said first body;

a second body that also has an outer surface and an inner surface that is oppositely disposed from said outer surface to define a wall between said outer surface and said inner surface, said wall of said second body defining a second polygonal profile that is different from said first polygonal profile and being located circumferentially around a longitudinal axis of said second body, said second body being engaged with said first body at times when the longitudinal axis of the second body is substantially parallel with the longitudinal axis of said first body and at least a portion of the outer surface of the wall of said second body faces at least a portion of the inner surface of the wall of said first body;

a latchway having at least one row of engagement elements, said latchway being located on at least one of the outer surface of the wall of said second body or the inner surface of the wall of said first body;

at least one latch member that is located on the other of said outer surface of the wall of said second body or the inner surface of the wall of said first body from said latchway; and at least one slideway that is defined by a gap between the outer surface of the polygonal wall of the second body and the inner surface of the polygonal wall of said first body at times when said latch member engages said latchway, said slideway being positioned circumferentially apart from at least one latchway or from at least one latch member, said first body being moveable in the circumferential direction with respect to said second body between a locked position wherein said at least one latch member said latchway to lock the longitudinal position of said first body with respect to said second body, and a displacement position wherein the polygonal wall of said first body is twisted against the polygonal wall of said second body to place said latchway or said at least one latch member in said at least one slideway and disengage said at least one latch member from said latchway to unlock the longitudinal position of said first body with respect to said second body such that said latchway or said at least one latch member is longitudinally moveable in said slideway and said first body is longitudinally moveable with respect to said second body, wherein the at least one slideway is disposed adjacent at least one corner of the outer surface of the wall of the second body.

2. The packaging according to claim 1 wherein said at least one latch member comprises a single notch on one of the first or second body or a row of notches on one of the first or second body.

3. The packaging according to claim 1 wherein the at least one slideway is disposed on the outer surface of the wall of the second body or the inner surface of the wall of the first body and circumferentially apart from a corner of either of said walls.

4. The packaging according to claim 1 wherein an elastic torque resistance is overcome by twisting the first and second bodies with respect to each other in moving the at least one latch member between the latchway and the slideway.

5. The packaging according to claim 1 wherein there is a transition area between the slideway and the latchway on one of said first and second bodies, said transition area including a deforming edge that protrudes inwardly from the wall of said first body such that when the at least one latch member that is disposed on the other of said first and second bodies is moved circumferentially between the slideway and the latchway, said at least one latch member interferes with said deforming edge to deform it within its elastic limit.

6. The packaging according to claim 1 wherein said gap between said inner surface of said first body and the outer surface of said second body includes said slideway at times when said first and second bodies are in the locked position and said gap between said inner surface of said first body and the outer surface of said second body includes said latchway or said at least one latch member at times when said first and second bodies are in the unlocked position.

7. The packaging according to claim 1 wherein the profile of a longitudinal end of the second body differs from the profile of a longitudinal end of the first body.

8. The packaging according to claim 1 wherein during the circumferential movement of the first body with respect to the second body, a gap occurs between the inner side of the wall of the first body and the outer side of the wall of the second body.

9. The packaging according to claim 1 wherein said at least one latch member is shaped invertedly with respect to the shape of each of the engagement elements of said latchway such that at least one latch member is moveable in the longitudinal direction over said engagement elements such that said first and second bodies are longitudinally moveable in one direction at times when the first and second bodies are in the locked position.

10. The packaging according to claim 9 wherein said engagement elements of said latchway comprise respective notches and wherein said at least one latch member comprises at least one latch notch, the orientation of said latch notch being inverted with respect to the orientation of said latches such that said latch notch travels over said notches during relative movement of the first and second bodies in one longitudinal direction while in the locked position and an engagement edge of said latch notch opposes a surface of said notches to prevent relative movement of the first and second bodies in the opposite longitudinal direction while in the locked position.

11. The packaging according to claim 1 wherein said at least one latch member has an engagement edge that opposes an engagement edge of at least one member of the latchway at times when said at least one latch member is in registry with the row of elements of said latchway.

12. The packaging according to claim 1 wherein the engagement elements of said latchway comprise respective notches in said first body or said second body.

13. The packaging according to claim 1 wherein said at least one latch member comprises at least one latch notch in said first body or said second body.

14. The packaging according to claim 1 wherein the engaging elements of said latchway define respective surfaces that face said slideway at times when the packaging is in the unlocked position and said elements are located in said slideway, said slideway having a surface that faces said elements and that is complementary to the surface of the engaging elements so as to guide the engaging elements along said slideway.

15. The packaging according to claim 1 wherein said at least one latch member defines a surface that faces said slideway at times when the packaging is in the unlocked position and said at least one latch member is located in said slideway, said slideway having a surface that faces said at least one latch member and that is complementary to the surface of said at least one latch member so as to guide said at least one latch member along said slideway.

* * * * *